US007768467B2

(12) United States Patent
Iwasaki

(10) Patent No.: US 7,768,467 B2
(45) Date of Patent: Aug. 3, 2010

(54) CIRCULARLY POLARIZED LOOP ANTENNA

(75) Inventor: Tatsuhiko Iwasaki, Nishinomiya (JP)

(73) Assignee: Furuno Electric Company Limited, Nishinomiya-shi (JP)

( * ) Notice: Subject to any disclaimer, the term of this patent is extended or adjusted under 35 U.S.C. 154(b) by 86 days.

(21) Appl. No.: 11/630,843

(22) PCT Filed: Jun. 9, 2005

(86) PCT No.: PCT/JP2005/010619

§ 371 (c)(1),
(2), (4) Date: Dec. 21, 2006

(87) PCT Pub. No.: WO2006/001180

PCT Pub. Date: Jan. 5, 2006

(65) Prior Publication Data

US 2008/0018547 A1 Jan. 24, 2008

(30) Foreign Application Priority Data

Jun. 24, 2004 (JP) ..... 2004-186812

(51) Int. Cl.
*H01Q 11/12* (2006.01)
*H01Q 7/00* (2006.01)

(52) U.S. Cl. ..... 343/743; 343/866; 343/870; 343/744; 343/741

(58) Field of Classification Search ..... 343/700 MS, 343/866, 870, 841, 741–744
See application file for complete search history.

(56) References Cited

U.S. PATENT DOCUMENTS 3,582,951 A * 6/1971 Altmayer ..... 343/718
4,801,944 A * 1/1989 Madnick et al. ..... 343/744
5,977,921 A * 11/1999 Niccolai et al. ..... 343/741
6,342,856 B1 * 1/2002 Nakano et al. ..... 343/700 MS
2004/0217907 A1 11/2004 Inoue

FOREIGN PATENT DOCUMENTS

| | | |
|---|---|---|
| JP | 6-268432 | 9/1994 |
| JP | 8-17289 | 2/1996 |
| JP | 3431045 | 5/2003 |
| JP | 2003-163531 | 6/2003 |
| JP | 2003-332837 | 11/2003 |

OTHER PUBLICATIONS

Cover Page of International Search Report dated Jul. 12, 2005.

* cited by examiner

*Primary Examiner*—Douglas W Owens
*Assistant Examiner*—Jennifer F Hu
(74) *Attorney, Agent, or Firm*—Nutter McClennen & Fish LLP; John J. Penny, Jr.

(57) ABSTRACT

An easy-to-fabricate and relatively strong circularly polarized loop antenna of a simple construction is built. A circularly polarized loop antenna 1 has a loop section 11, which is made up of a loop-shaped conductor whose length is equal to 1 wavelength (λ) of the transmitted and received signals, and a coupling section 12, made up of a conductor, is connected thereto at a prescribed point. The coupling section 12 is shaped such that it is connected to the loop section 11 at a connection point 201 at one end and extends along the loop section 11 throughout a length equal to λ/4. A reflective plate 2 is placed in a predetermined position in the vertical direction from the circumferential plane of the loop section 11, in parallel to the circumferential plane. In addition, the other end of the loop section 11 is connected to external circuitry carrying out the processing of signals transmitted and received via a first feed conductor 13 and a second feed conductor 14 and operates as a feed point, 200.

5 Claims, 22 Drawing Sheets

CIRCULARLY POLARIZED LOOP ANTENNA

CROSS REFERENCE OF RELATED APPLICATION

Japanese Patent Application Tokugan No. 2004-186812 is hereby incorporated by reference.

TECHNICAL FIELD

This invention relates to an antenna generating circularly polarized waves, in particular, to a circularly polarized loop antenna generating circularly polarized waves from a loop-shaped conductor whose length is equal to 1 wavelength of the transmitted and received signals.

BACKGROUND ART

Loop antennas comprising loop-shaped conductors, curl antennas comprising curl-shaped conductors, and other types of antennas have been designed in the past as antennas for generating circularly polarized waves.

Disclosed loop antennas include an antenna comprising a C-type loop element obtained by cutting out a predetermined gap in a portion of a loop-shaped conductor, whose length is approximately equal to 1 wavelength of the radiated circularly polarized waves, a linear I-shaped conductor one end of which is connected to the C-type loop element and the other end of which serves as a feed point, a ground plane disposed in parallel to the C-type loop element, and a feed conductor, which is connected to the feed point and transmits electric power to the feed point (for example, see Patent document 1).

In addition, disclosed curl antennas include an antenna comprising a spiral-shaped curl section with a turns number in the range of from about 1 to about 1.5, in which a wire conductor is formed by joining semi-circles of different shape and whose length is approximately equal to 1 wavelength of the radiated circularly polarized waves, and a shaft section, one end of which is connected to the beginning of the curl section and the other end of which is connected to a power supply conductor (for example, see Patent document 2).

[Patent Document 1] Japanese Patent No. 3431045

[Patent Document 2] JP H8-17289B.

DISCLOSURE OF INVENTION

Problem to be Solved by the Invention

However, the strength of the loop antenna described in Patent document 1 was low because it was a C-type loop antenna with a section of the loop-shaped conductor cut out with a predetermined gap, i.e. it was not a closed shape.

Additionally, the curl antenna described in Patent document 2 had low strength because it was not a closed-shaped antenna, in the same manner as the above-mentioned C-type loop antenna, and moreover, because it was curled, the shape required to obtain the prescribed characteristics was not easy to maintain.

Therefore, it is an object of the present invention to build an easy-to-fabricate and relatively strong circularly polarized loop antenna of a simple construction.

Means for Solving Problem

This invention provides a circularly polarized loop antenna comprising a loop section made up of a conductor, the length of a single turn of which is approximately equal to 1 wavelength of the transmitted and received signals, and a feed section performing input/output of signals to/from the loop section, wherein the feed section comprises a coupling section which has one end connected to the loop section and the other end to a feed point, and which extends from the point of connection to the loop section along the loop section for a length approximately equal to ¼ of the wavelength.

Because in this configuration the loop section has a length approximately equal to 1 wavelength of the transmitted and received signals and the coupling section has a length equal to ¼ of the wavelength, in accordance with the principle described below, there are essentially two standing waves generated in the loop section.

FIG. 17 is a conceptual diagram of the antenna comprising a semi-infinite line and a line used for coupling to a feed point.

As illustrated in FIG. 17, this antenna comprises a semi-infinite line 51, a feed point 50 and a coupling line 52 of a length equal to ¼ of the transmitted signals, running from the end of the semi-infinite line 51 along the semi-infinite line 51, and a switch 53 grounding the point of connection 500 between the semi-infinite line 51 and the coupling line 52.

First of all, when the switch 53 is turned off, the connection point 500 is released, with the connection point 500 operating as a node and generating a current standing wave in the semi-infinite line 51 and coupling line 52, as illustrated in FIG. 18.

FIG. 18 is a diagram illustrating a current standing wave Iw1 obtained when the switch 53 is turned off in the antenna shown in FIG. 17.

Here, the location of 1 wavelength (λ) of the transmitted signal from the point of connection 500 of the semi-infinite line 51 to the coupling line 52 corresponds, quite naturally, to a node of the current standing wave Iw1. For this reason, a similar current standing wave is generated if the semi-infinite line 51 is cut at a point corresponding to 1 wavelength (λ) from the connection point 500 and connected to the connection point 500. Thus, a construction, in which the severed line 51' is imparted a circular configuration and a coupling line 52 is disposed therealong, corresponds to the circularly polarized loop antenna of the present invention. In other words, a current standing wave identical to the current standing wave Iw1 illustrated in FIG. 19 is generated in the circularly polarized loop antenna of the present invention.

On the other hand, when the switch 53 is turned on, the connection point 500 is shorted to the ground, with the connection point 500 operating as an antinode and generating a current standing wave Iw2 in the semi-infinite line 51 and coupling line 52, as illustrated in FIG. 20.

FIG. 20 is a diagram illustrating a current standing wave Iw2 obtained when the switch 53 is turned on in the antenna shown in FIG. 17.

Here, the position of 1 wavelength (λ) of the transmitted signal from the point of connection 500 of the semi-infinite line 51 to the coupling line 52 corresponds, quite naturally, to an antinode of the current standing wave Iw2. For this reason, a similar current standing wave Iw2 is generated if the semi-infinite line 51 is cut at a point corresponding to the length of 1 wavelength (λ) from the connection point 500 and connected to the connection point 500. Thus, the construction, in which the severed line 51' is imparted a circular configuration and a coupling line 52 is disposed therealong, also corresponds to the circularly polarized loop antenna of the present invention. In other words, a current standing wave identical to the current standing wave Iw2 illustrated in FIG. 21 is generated in the circularly polarized loop antenna of the present invention.

In this manner, with a single feed point, the thus configured circularly polarized loop antenna of the present invention forms two virtual feed points spaced at an interval of ¼ of the wavelength along the loop section, with respective standing waves generated by these two virtual feed points. This actually corresponds to the construction of an ideal circularly polarized loop antenna 1, as illustrated in FIG. 22. FIG. 22 is a schematic view of an ideal circularly polarized loop antenna 1. In FIG. 22, 1 represents an antenna, Sa and Sb feed points, and Ia and Ib current standing waves generated at the feed points Sa and Sb, respectively.

In addition, the loop antenna of this invention is characterized by the fact that the coupling section is arranged on the inner periphery of the loop section.

In this configuration, a one-layer electrode pattern etc. is used to implement an antenna configuration, where the coupling section is arranged on the inner periphery of the loop section, as a result of which the loop section and the coupling section are arranged within the same plane and, at the same time, the coupling section is connected to the point of connection to external circuitry disposed in the central location of the loop section.

In addition, the loop antenna of this invention is characterized by the fact that the coupling section is arranged on the side of the loop section facing the reflective plate.

Because in this configuration the coupling section is arranged on the side facing the principal direction of radiation of circularly polarized waves from the loop section, the effects exerted by the coupling section on the radiation characteristics are suppressed.

In addition, the loop antenna of this invention is characterized by the fact that the coupling section is arranged on the outer periphery of the loop section.

In this configuration, by arranging the coupling section on the outer periphery of the loop section, the impedance of the loop antenna is decreased from at least 150Ω to about 50Ω.

In addition, the loop antenna of the present invention is characterized by the fact that the feed section comprises a matching section performing impedance matching on signals supplied to the coupling section or signals outputted from the coupling section.

In this configuration, the loop antenna has the desired radiation characteristics and even if its impedance is different from external connect circuitry, e.g. transmit signal generating circuitry or receive signal processing circuitry, etc., impedance matching is carried out by the matching section.

Effects of the Invention

Based on this invention, an ideal 1-wavelength loop antenna can be built by providing it with a loop-shaped conductor of a closed shape, whose length is approximately equal to 1 wavelength (λ) of the transmitted and received signals, and a coupling section extending in parallel to the loop-shaped conductor for a length approximately equal to ¼ of the wavelength, and by connecting one end of the coupling section to the loop-shaped conductor and the other end to a feed point. This makes it possible to build an easy-to fabricate and relatively strong circularly polarized loop antenna with a superior axial ratio and a simple construction.

In addition, in accordance with this invention, arranging the coupling section on the inner periphery of the loop section permits implementation of a loop antenna on a one-layer electrode pattern substrate. This makes it possible to build a simple loop antenna providing the effects described above.

In addition, this invention improves radiation characteristics by arranging the coupling section on the side of the loop section facing the reflective plate. In other words, a loop antenna can be built that has better radiation characteristics.

In addition, in accordance with this invention, arranging the coupling section on the outer periphery of the loop section makes it possible to adjust the impedance of the loop antenna to about 50Ω and enables it to be directly connected to 50-Ω transmission lines typically used in communication systems as well as to be directly used with 50-Ω electric components and measurement devices, which permits easy and inexpensive antenna assembly, tuning and inspection.

In addition, in accordance with this invention, connecting the coupling section to external circuitry through a matching section suppresses signal transmission losses in the process of input/output between the loop antenna and the external circuitry and makes it possible to build a circularly polarized loop antenna possessing highly efficient transmission-reception characteristics.

DESCRIPTION OF REFERENCE NUMERALS

1. Loop antenna.
2. Reflective plate.
11. Loop section.
110. Opposed portion of the loop section 11.
12. Coupling section.
13. First feed conductor.
14. Second feed conductor.
15. Coaxial cable.
16. Microstrip circuit.
17. Feed conductor.
200. Feed point.
201. Connection point.

BEST MODE FOR CARRYING OUT THE INVENTION

Figure 1:
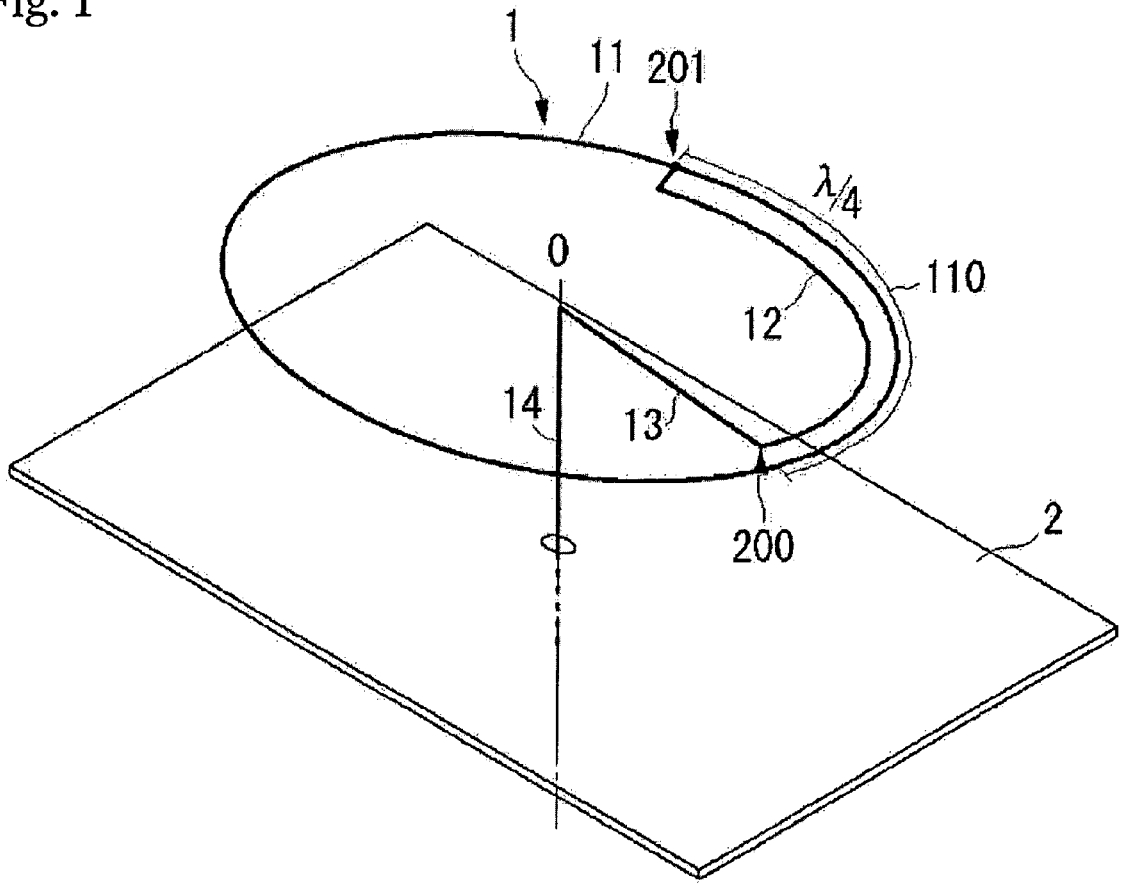
FIG. 1 is an outside perspective view showing a schematic configuration of the circularly polarized loop antenna of a first embodiment.

The circularly polarized loop antenna of a first embodiment of the present invention will be explained by referring to drawings. FIG. 1 is an outside perspective view showing a schematic configuration of the circularly polarized loop antenna used in the present embodiment. In addition, FIG. 2 (*a*) is a plan view and (*b*) a cross-sectional side view of the circularly polarized loop antenna illustrated in FIG. 1.

As shown in FIG. 1, a loop section 11 of a circularly polarized loop antenna 1 of the present embodiment is made up of a loop (circular)-shaped conductor whose length constitutes approximately 1 wavelength (λ) of the transmitted and received signals, with a coupling section 12, also made up of a conductor, connected thereto at one point. The coupling section 12 is shaped such that it is connected to the loop section 11 at a connection point 201 at one end and extends along the loop section 11 throughout a length approximately equal to ¼ of the wavelength λ. At such time, the coupling section 12 is arranged on the inside of the loop section 11, within the same plane as the circumferential plane of the loop section 11 and spaced a predetermine distance from the loop section 11. The other end of the coupling section 12, in other words, the end opposite the connection point 201, is a feed point, 200, which is connected to a first feed conductor 13 extending in the direction from the feed point 200 towards the center O of the loop section 11. The end of the first feed conductor 13 opposite the feed point 200 is connected to a second feed conductor 14, which extends along a center line passing through the center O of the loop section 11 and relays transmitted signals from the outside to the first feed conductor 13 and received signals from the first feed conductor 13 to the outside. The second feed conductor 14 extends towards a reflective plate 2 (in the vertical direction in the figure) along the center line and is connected to outside circuitry on the side opposite the side of the reflective plate 2, on which the loop antenna 1 is arranged.

Additionally, a reflective plane 2, which is made up of a conductor formed to have a surface area that is at least greater than the surface area of the loop section 11, is located in a position spaced a predetermined distance from the circumferential plane of the loop section 11 towards the second feed conductor 14 (vertically downwards in the figure), with a through hole formed in the reflective plate 2 and the second feed conductor 14 passing through the through hole and connected via the reflective plate 2 to the external circuitry located opposite the loop section 11. Here, in the present embodiment, the coupling section 12, first feed conductor 13, and second feed conductor 14 correspond to the "feed section" of the present invention.

Because in the thus configured circularly polarized loop antenna the loop section 11 has a length approximately equal to 1 wavelength of the transmitted and received signals and the coupling section 12 has a length equal to ¼ of the wavelength, in accordance with the principle described below, there are essentially two standing waves generated in the loop section 11.

Because the loop section 11 has a length approximately equal to 1 wavelength (λ) of the transmitted and received signals, with respect to the standing wave, it can be viewed as an equivalent of a semi-infinite line ending in the connection point 201. In addition, the coupling section 12 can be viewed as a feed line having one end at the connection point 201, extending along the semi-infinite line (loop section 11) for a length equal to ¼ of the wavelength of the transmitted and received signals, and having its other end at the feed point.

Figure 18:
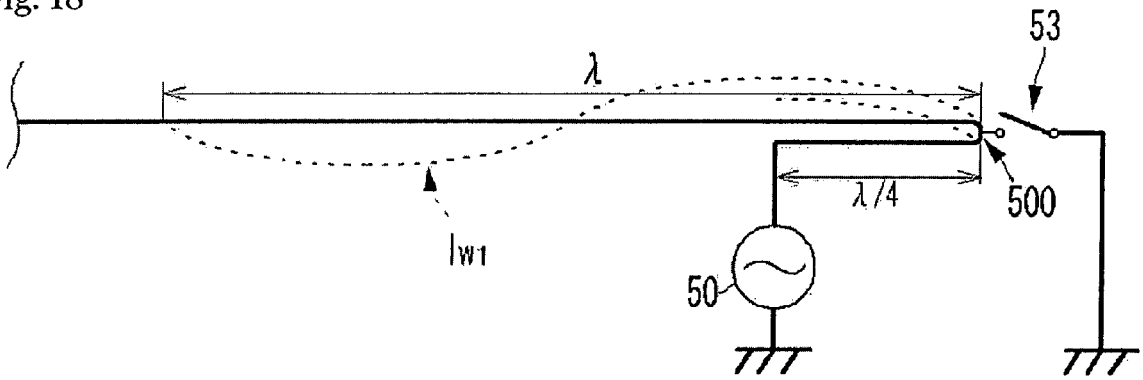
FIG. 18 is a diagram illustrating a current standing wave Iw1 obtained when the switch 53 is turned off in the antenna shown in FIG. 17.
Figure 20:
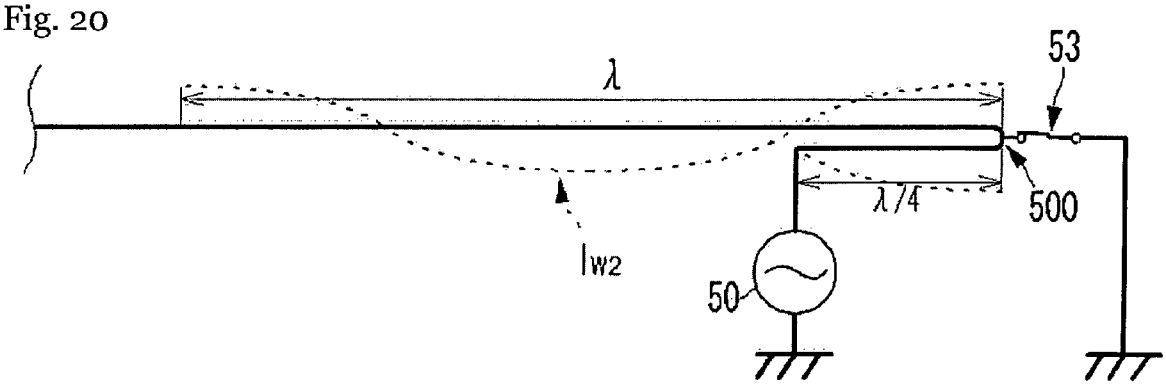
FIG. 20 is a diagram illustrating a current standing wave Iw2 obtained when the switch 53 is turned on in the antenna shown in FIG. 17.

In the thus constructed antenna, two standing waves are generated depending on the state of the connection point 201, with the waves having a mutual phase difference corresponding to the length of λ/4. In other words, if the connection point 201 is grounded, the current standing wave illustrated in FIG. 20 is generated, and if the connection point 201 is released (not grounded), then the current standing wave illustrated in FIG. 18 is generated.

Figure 19:
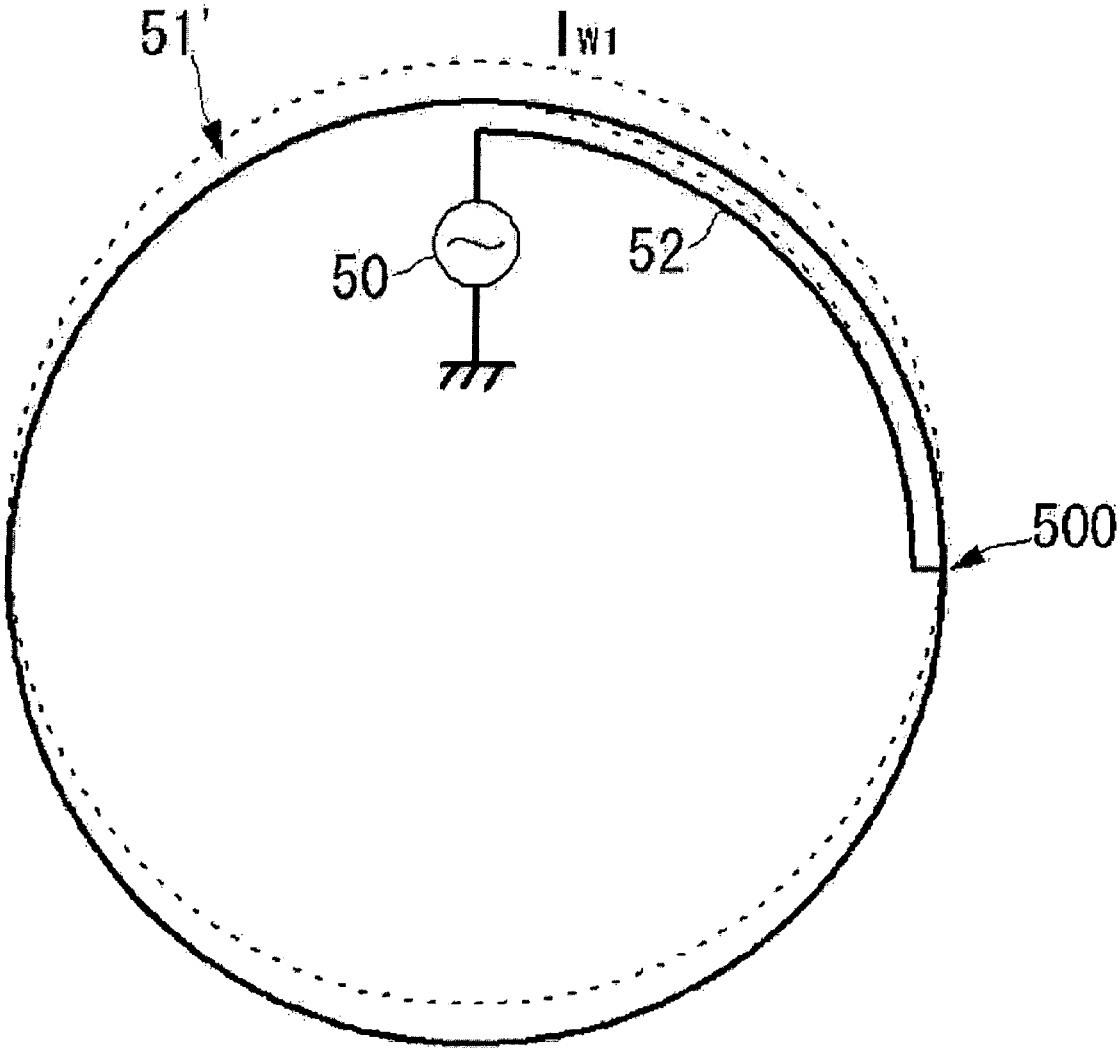
FIG. 19 is a diagram illustrating a current standing wave Iw1 obtained when the antenna shown in FIG. 18 is substituted for the loop antenna.
Figure 21:
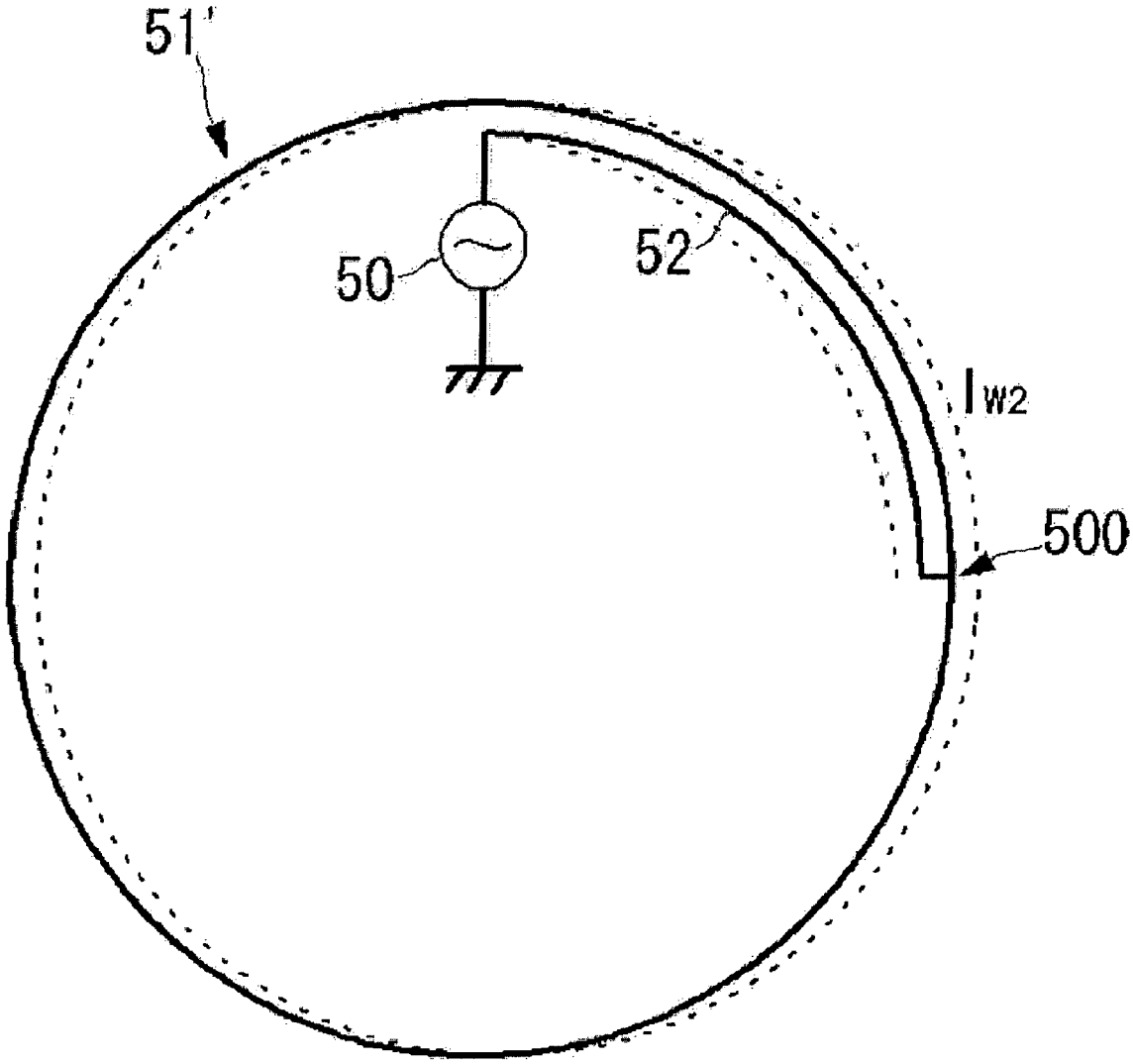
FIG. 21 is a diagram illustrating a current standing wave Iw2 obtained when the antenna shown in FIG. 20 is substituted for the loop antenna.
Figure 22:
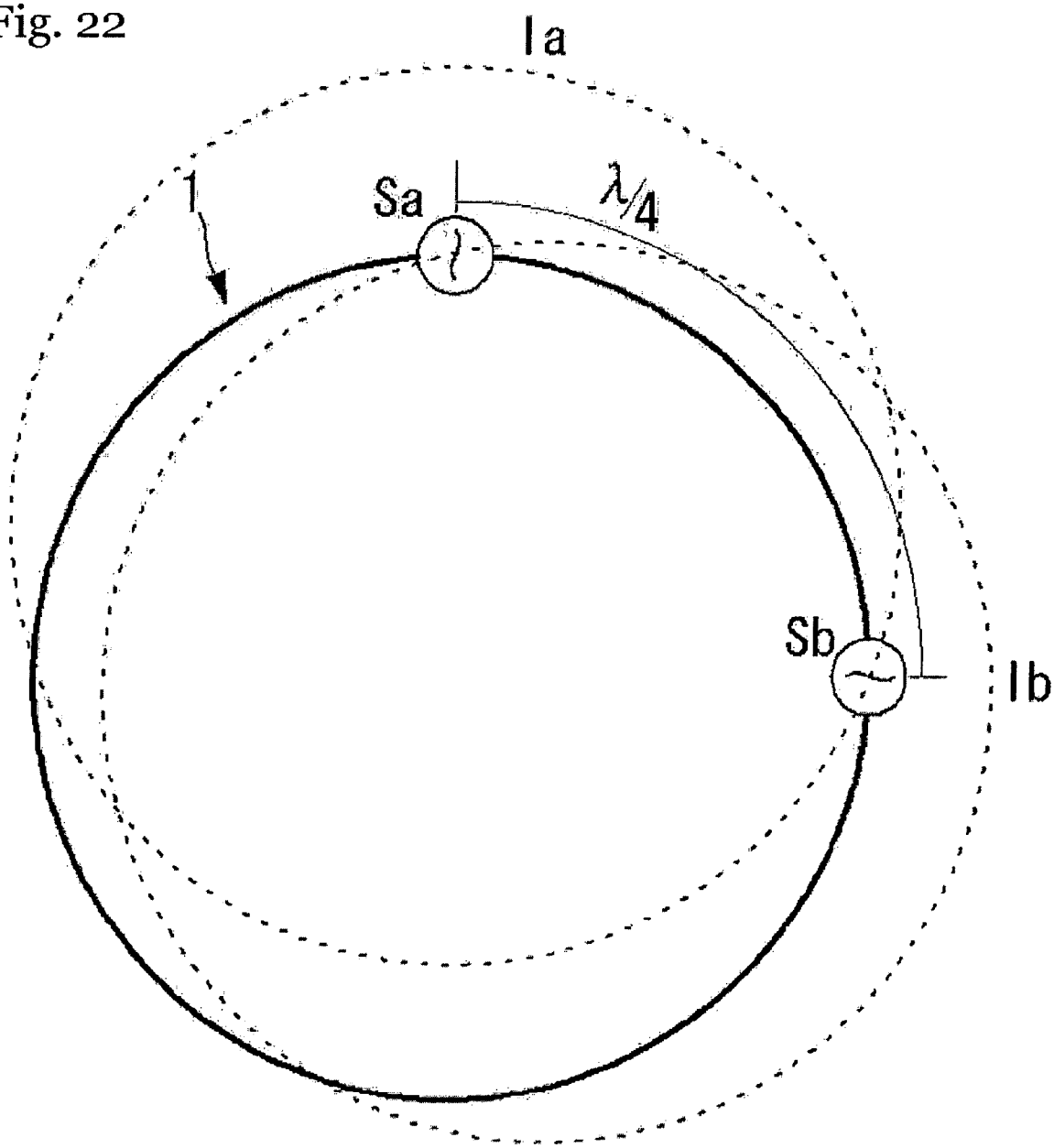
FIG. 22 is an equivalent circuit for the loop antenna.

When these states are applied to a loop-shaped antenna, namely, the circularly polarized loop antenna 1, grounding the connection point 201 generates the current standing wave illustrated in FIG. 21 and releasing the connection point 201 generates the current standing wave illustrated in FIG. 19. In terms of signal phase difference, the difference between the grounded state and released state corresponds to the length of λ/4 of the signal. In other words, as shown in FIG. 22, in the circularly polarized loop antenna 1, there are two current standing waves Ia, Ib produced by the virtual feed points Sa, Sb located in positions spaced a distance of λ/4 along the loop section 11. These virtual feed points Sa, Sb can be implemented using signal power inputted via the first and second feed conductors 13, 14.

As a result, the circularly polarized loop antenna 1 functions as an ideal circularly polarized loop antenna. In other words, the configuration of the present embodiment permits implementation of an ideal circularly polarized loop antenna of a simple construction possessing a superior axial ratio.

In addition, because in the configuration of the present embodiment the loop section 11 has a closed-loop shape, it has higher strength against external pressures in comparison with the C-type loop shape, which has a cutout portion, and the curl shape, which has different diameters at the initial point and final point. In addition, because the loop section 11 has a closed-loop shape and the coupling section has a matching shape, the antenna is easy to fabricate. Therefore, using the configuration of the present embodiment makes it possible to build a high-strength, easy-to-fabricate loop antenna.

Loop antenna simulation results obtained using the configuration of the present embodiment are explained next.

Figure 3:
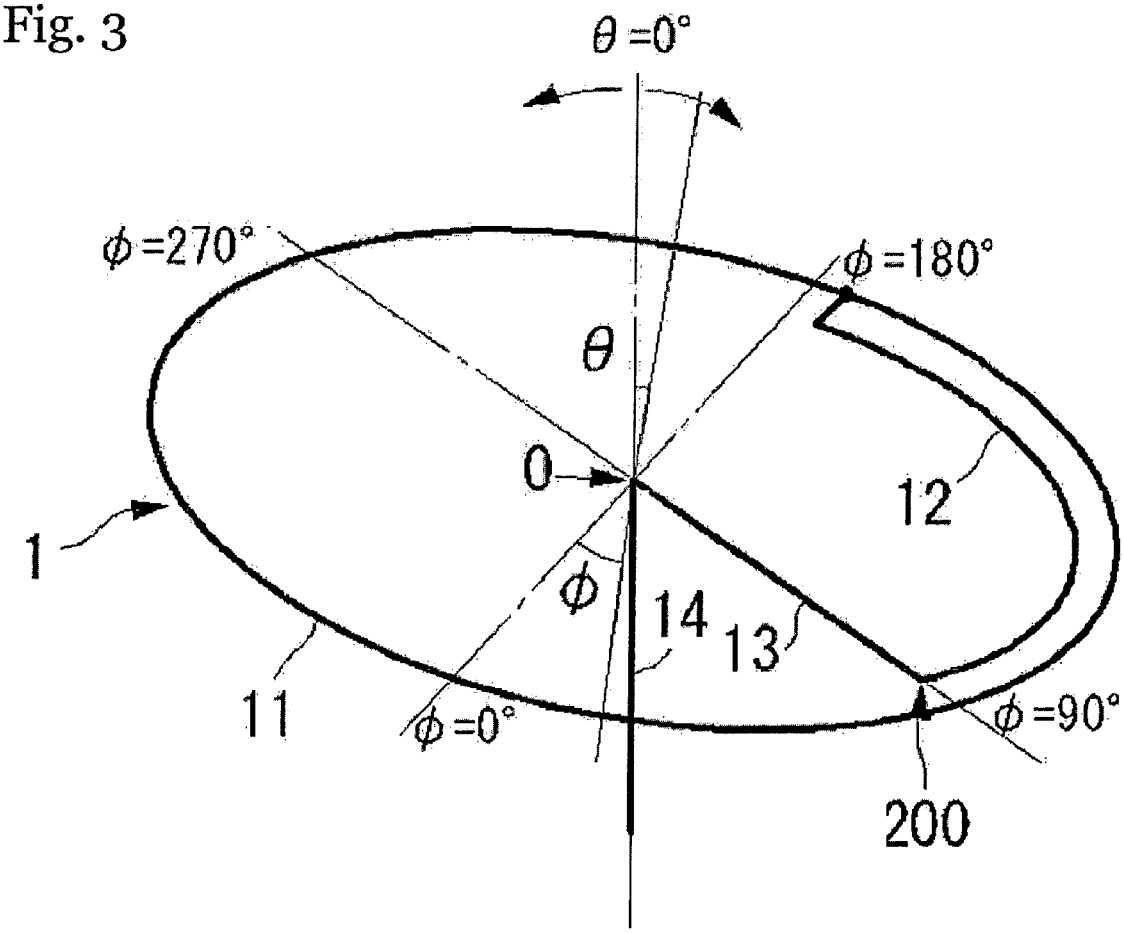
FIG. 3 is a diagram illustrating the definition of ø and θ of FIG. 5 and FIG. 6.
Figure 4:
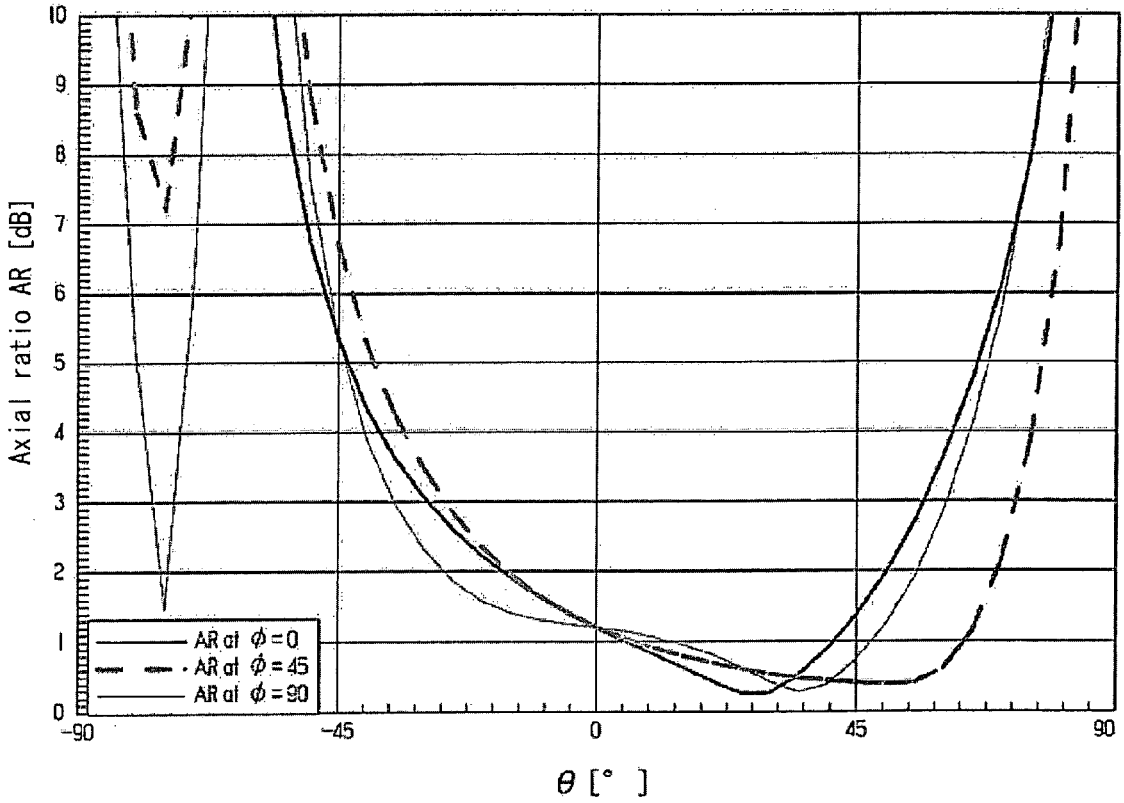
FIG. 4 is a graph illustrating axial ratio characteristic simulation results for the loop antenna of the first embodiment.
Figure 5:
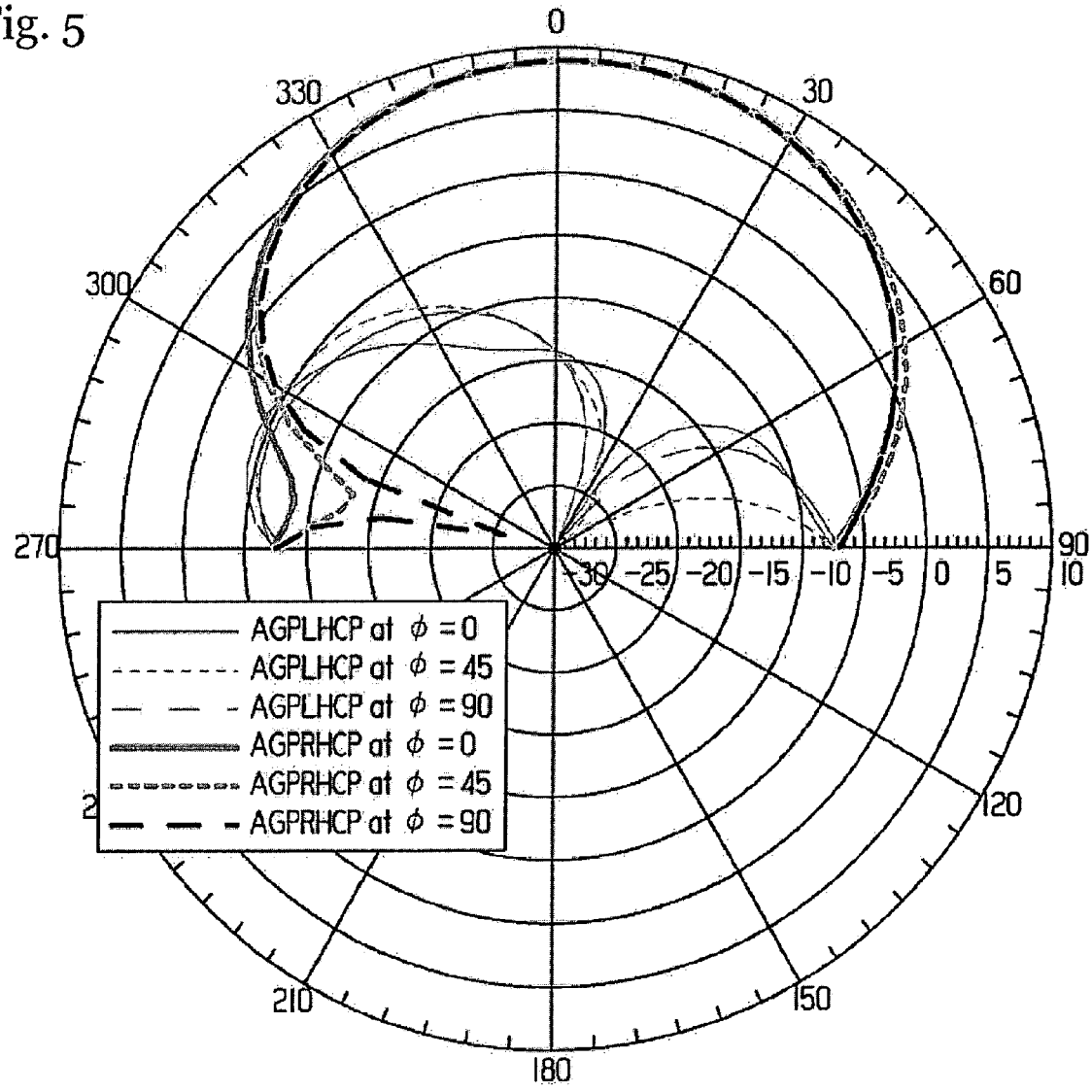
FIG. 5 is a graph illustrating axial ratio characteristic simulation results for the loop antenna of the first embodiment.

FIG. 3 is a diagram illustrating the definition of ø and θ in FIG. 4 to FIG. 5.

As shown in FIG. 3, ø is a horizontal angle measured in a direction parallel to the plane comprising the loop section 11, with the counterclockwise direction defined as the positive direction, such that the direction of the feed point 200 is at 90° relative to the center of the loop section 11. In addition, θ is a zenith angle, for which the direction facing the reflective plate 2, i.e. the central axial direction of the loop section 11, is defined as the zenith (θ=0°) and, relative to horizontal angular directions having an angular difference of 180°, the direction towards smaller angles is defined as the positive direction and the direction towards larger angles is defined as the negative direction.

Figure 2:
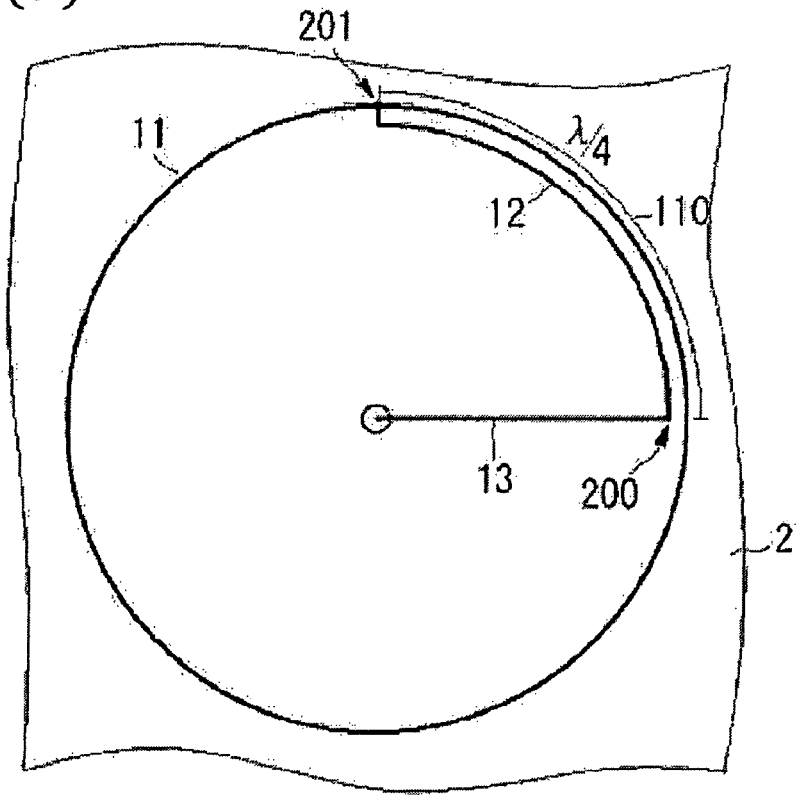
FIG. 2 is a plan view, as well as a cross-sectional side view, of the circularly polarized loop antenna illustrated in FIG. 1.
Figure 2:
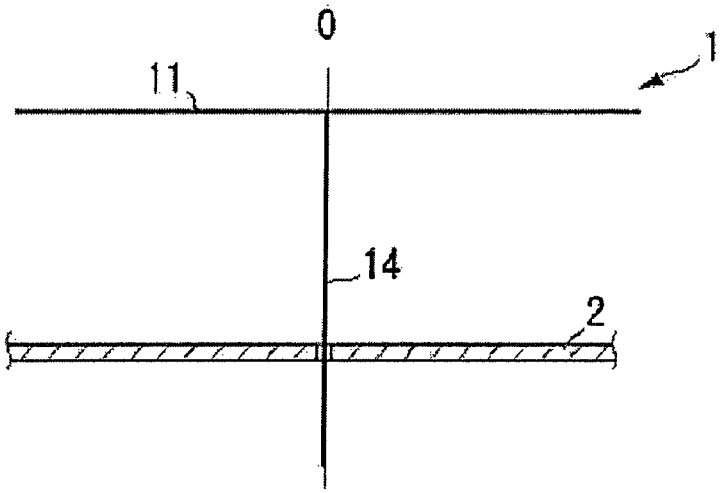

FIG. 4 is a graph illustrating axial ratio characteristic simulation results obtained for a 1420-MHz signal (circularly polarized waves) produced by a loop antenna of the shape illustrated in FIG. 1 and FIG. 2. In addition, FIG. 5 is a graph illustrating radiation characteristic simulation results obtained for a 1420-MHz signal (circularly polarized waves) produced by a loop antenna of the shape illustrated in FIG. 1 and FIG. 2. In FIG. 5, "AGPRHCP" represents the radiation characteristics of right-hand circularly polarized waves and "AGPLHCP" represents the radiation characteristics of left-hand circularly polarized waves.

It should be noted that, in the loop antenna used to obtain the simulation results illustrated in FIG. 4 and FIG. 5, the radius of the loop section 11 was approximately 30.8 mm, the diameter of the conductor that constituted the loop section 11 and coupling section 12 was approximately 1 mm, the gap between the loop section 11 and the coupling section 12 was 2 mm, the loop section 11 and coupling section 12 were connected at a point located at 84° in the counterclockwise direction from the feed point 200, and the loop section 11 was arranged so as to be spaced approximately 20 mm from the reflective plate 2 (an infinite planar conductor in the simulation).

As shown in FIG. 4, using the configuration of the present embodiment permits implementation of a loop antenna possessing superior axial ratio characteristics because the obtained axial ratio has a substantially unchanged and flat characteristic over a wide range from the zenith direction towards the zenith angle direction and has a substantially unchanged characteristic in the horizontal direction as well. In addition, a loop antenna can be implemented that radiates circularly polarized waves possessing superior directivity because, as shown in FIG. 5, the obtained radiation characteristics are substantially spherical, i.e. the obtained radiation characteristics are such that regardless of the angle in the horizontal direction, the cross-section is substantially circumferential, and the intensity of the undesirable left-hand circularly polarized waves is considerably weaker relative to the desirable right-hand circularly polarized waves.

Figure 6:
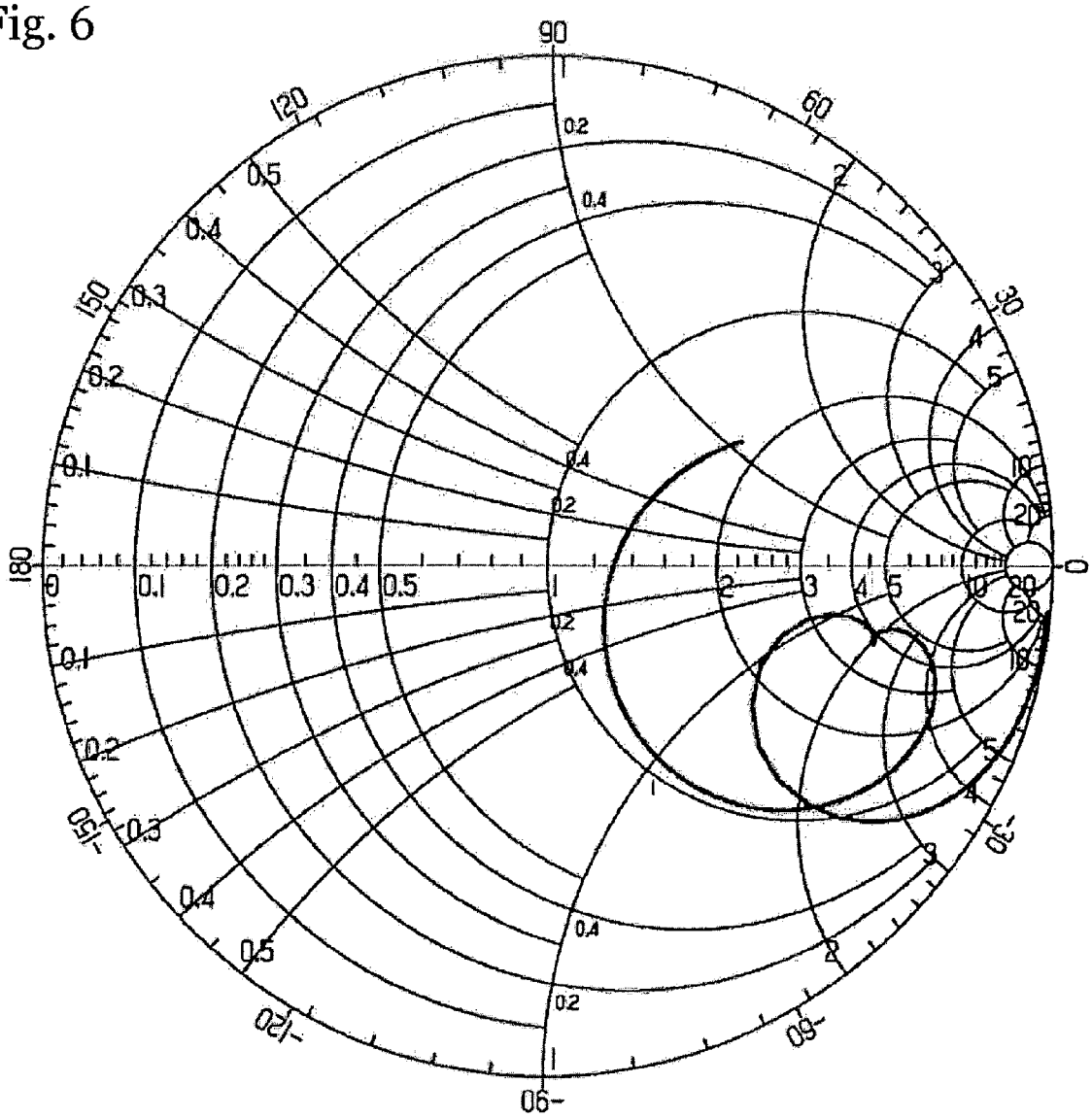
FIG. 6 is a Smith chart of the s11 characteristic of the loop antenna of the first embodiment.

A Smith chart obtained using a loop antenna of such a configuration is shown in FIG. 6.

FIG. 6 is a Smith chart of the s11 characteristic of a loop antenna constructed as illustrated in FIG. 1 and FIG. 2. In this manner, while impedance deviates from 5Ω when the configuration of the present embodiment is used, the deviation can be reduced either by connecting an impedance matching circuit, such as a coaxial cable etc., to the second feed conductor 14, or, as shown in FIG. 7, by using an impedance matching circuit, such as a coaxial cable 15, for the second feed conductor 14.

Figure 7:
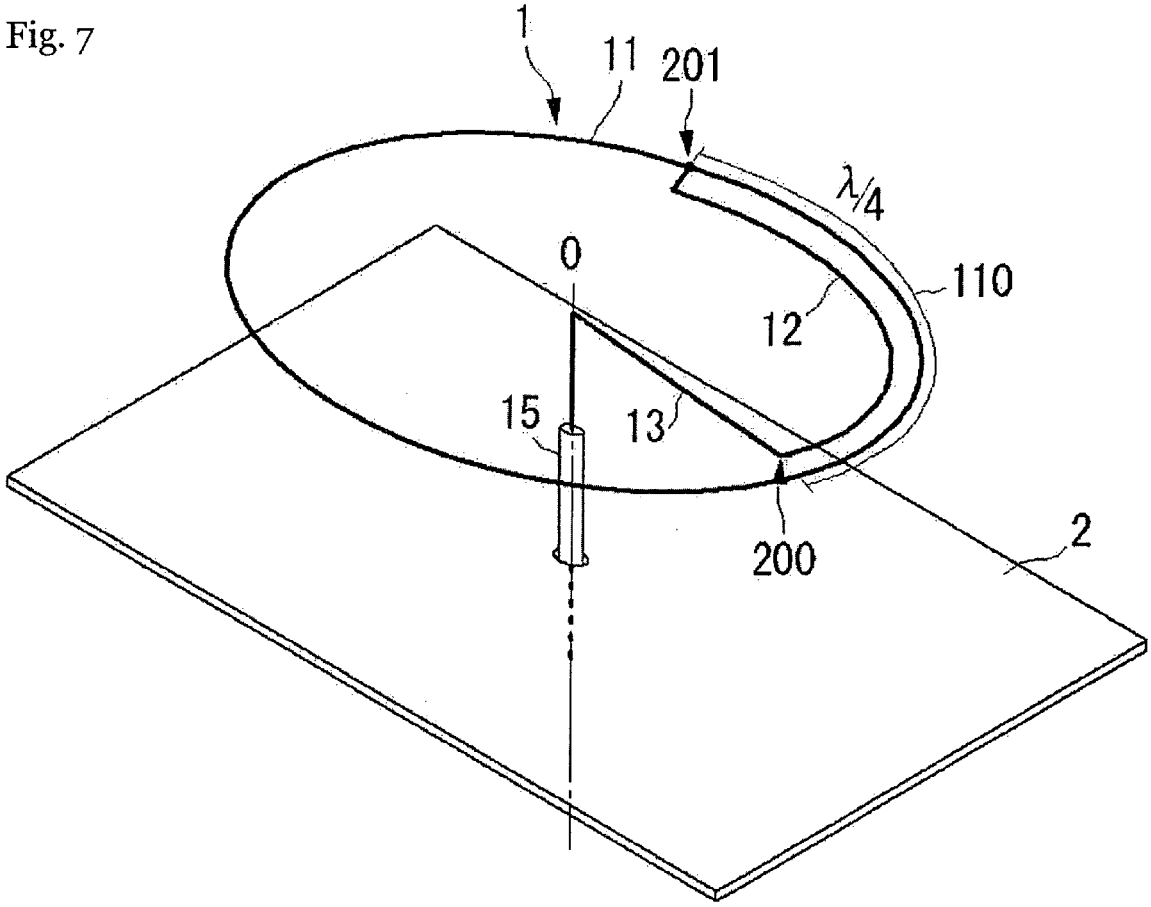
FIG. 7 is an outside perspective view illustrating another configuration of the loop antenna of the first embodiment.

FIG. 7 is an outside perspective view illustrating another configuration of the loop antenna of the present embodiment. In the construction of the loop antenna illustrated in FIG. 7, the first feed conductor 13 is connected to the coaxial cable 15 arranged along a central axis of the loop section 11, with the rest of the configuration being identical to the loop antenna illustrated in FIG. 1.

Figure 8:
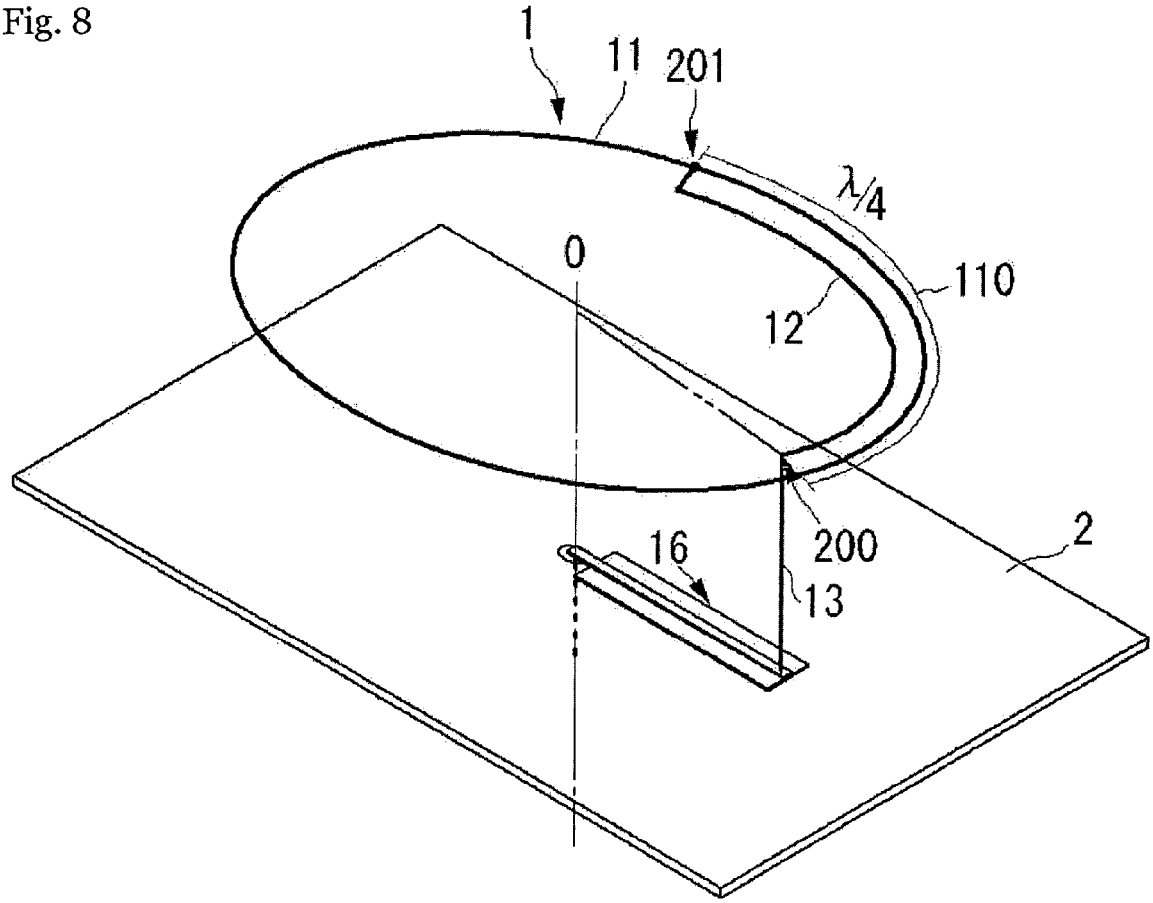
FIG. 8 is an outside perspective view illustrating yet another configuration of the loop antenna of the first embodiment.

In addition, as shown in FIG. 8, the impedance matching circuit may be made up of a microstrip circuit 16. FIG. 8 is an outside perspective view illustrating yet another configuration of the loop antenna of the present embodiment. In the configuration of the loop antenna illustrated in FIG. 8, the first feed conductor 13 extends from the feed point 200 in the direction of the reflective plate 2 (in the vertical direction) and is connected to a microstrip circuit 16 arranged on the top face of the reflective plate 2 (the face on the side of the loop section 11), with the rest of the configuration being identical to the loop antenna illustrated in FIG. 1. When this configuration is used, impedance matching can be performed as well.

As described above, using the configuration of the present embodiment makes it possible to build a high-strength, easy-to-fabricate loop antenna possessing superior axial ratio characteristics and directivity.

It should be noted that in the construction of the present embodiment, in which the coupling section is disposed on the inner periphery (towards the center) of the loop section, the loop section 11, the coupling section 12, and the first feed conductor 13 can be formed using a single layer on one of the faces of a single substrate and the loop antenna can be thus fabricated more easily.

The loop antenna of a second embodiment is explained next by referring to drawings.

Figure 9:
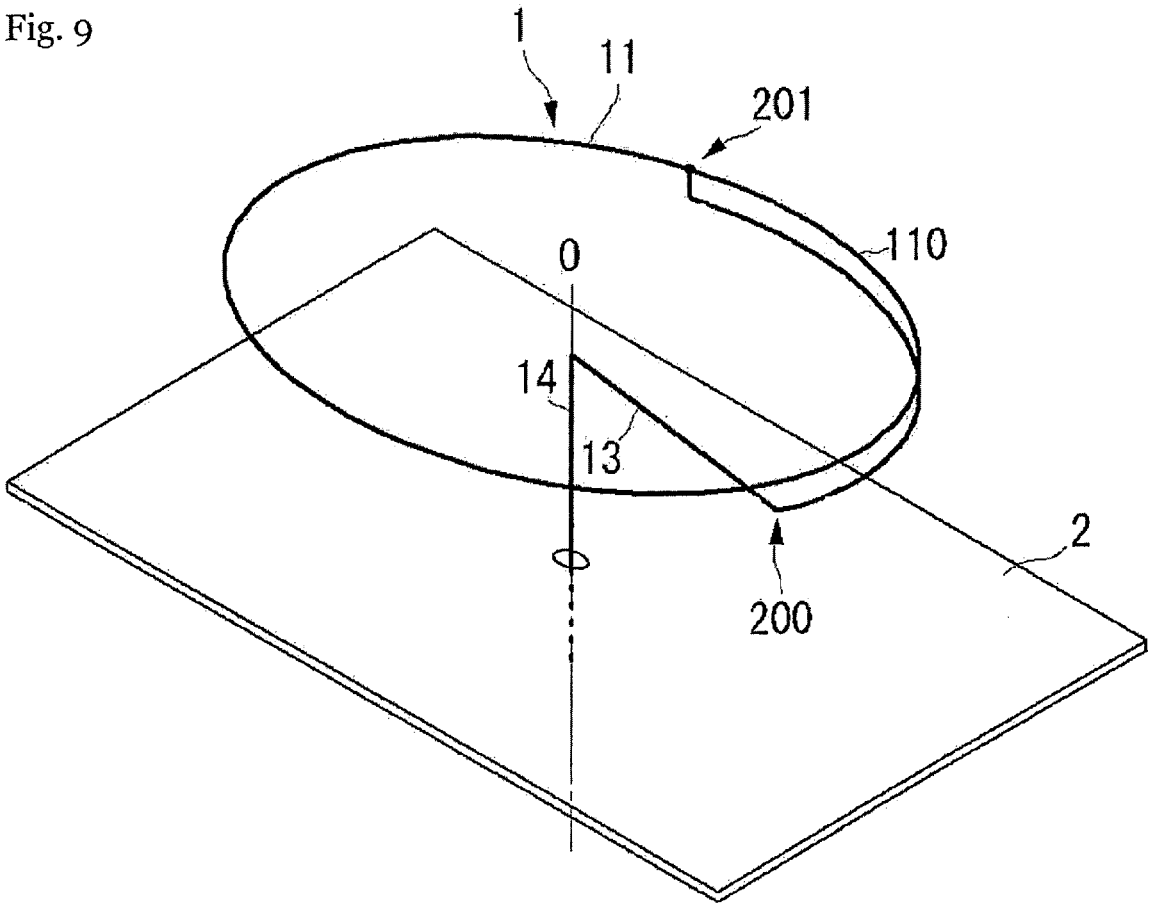
FIG. 9 is an outside perspective view showing a schematic configuration of the loop antenna of a second embodiment.

FIG. 9 is an outside perspective view illustrating a schematic configuration of the loop antenna of the present embodiment.

As shown in FIG. 9, in the loop antenna of the present embodiment, the coupling section 12 is arranged on the side of the loop section 11 facing the reflective plate 2, with the rest of the configuration being identical to the loop antenna illustrated in FIG. 1.

Figure 10:
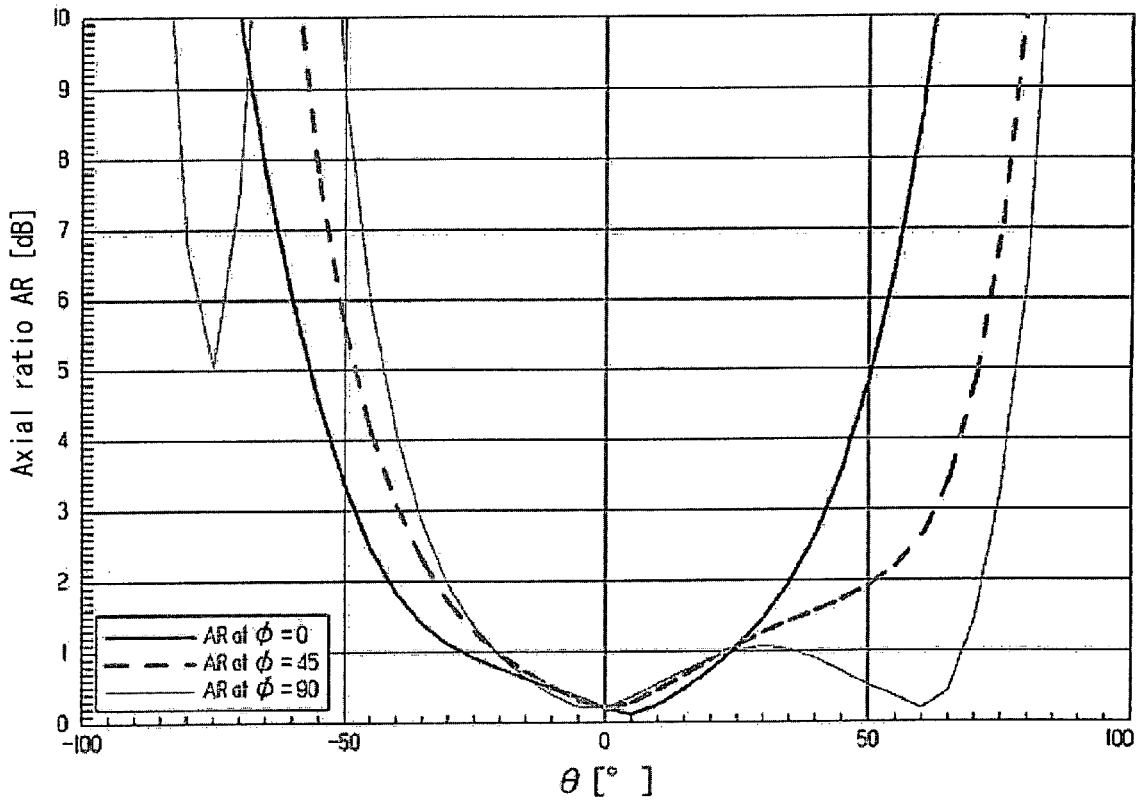
FIG. 10 is a graph illustrating axial ratio characteristic simulation results for the loop antenna of the second embodiment.
Figure 11:
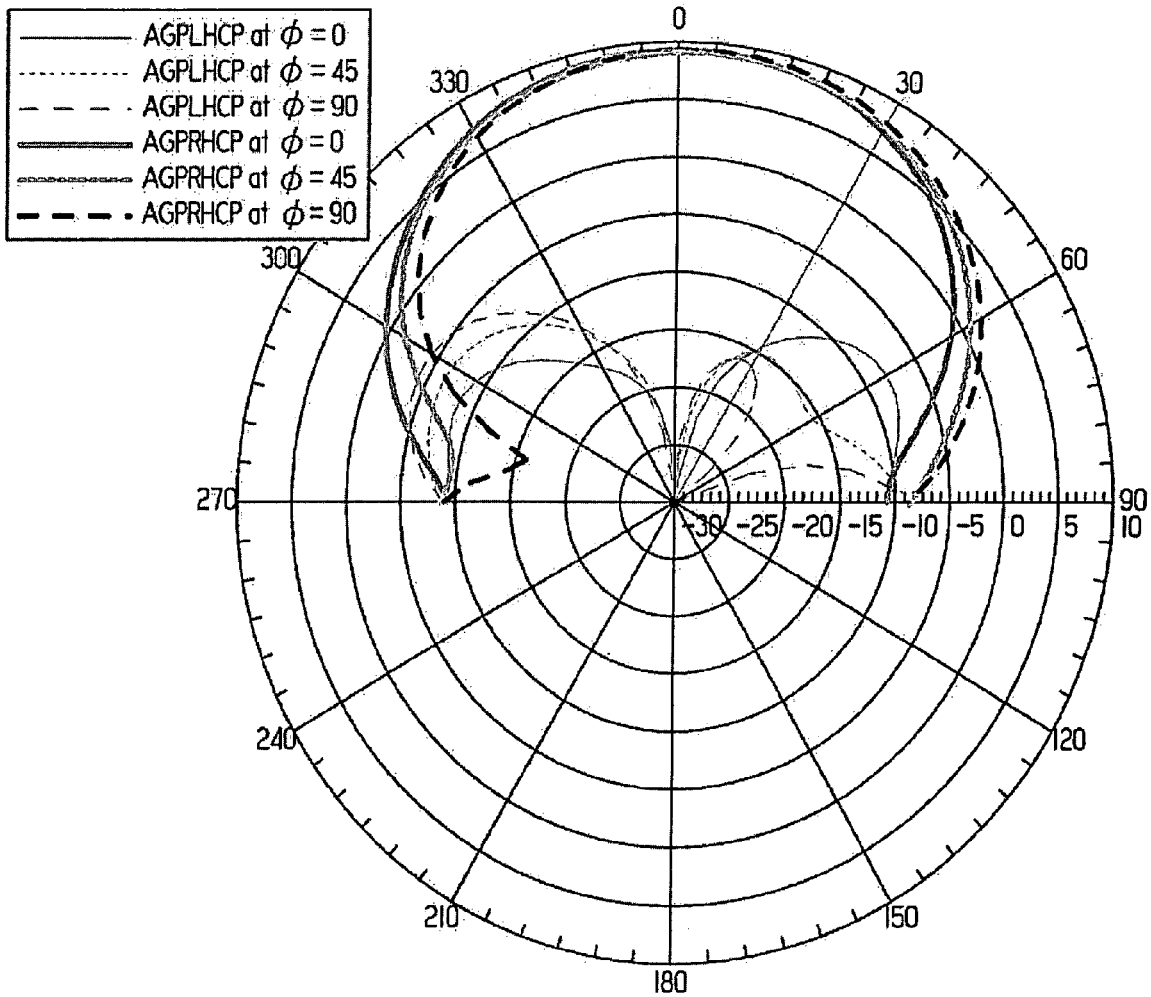
FIG. 11 is a graph illustrating radiation characteristic simulation results for the loop antenna of the second embodiment.
Figure 12:
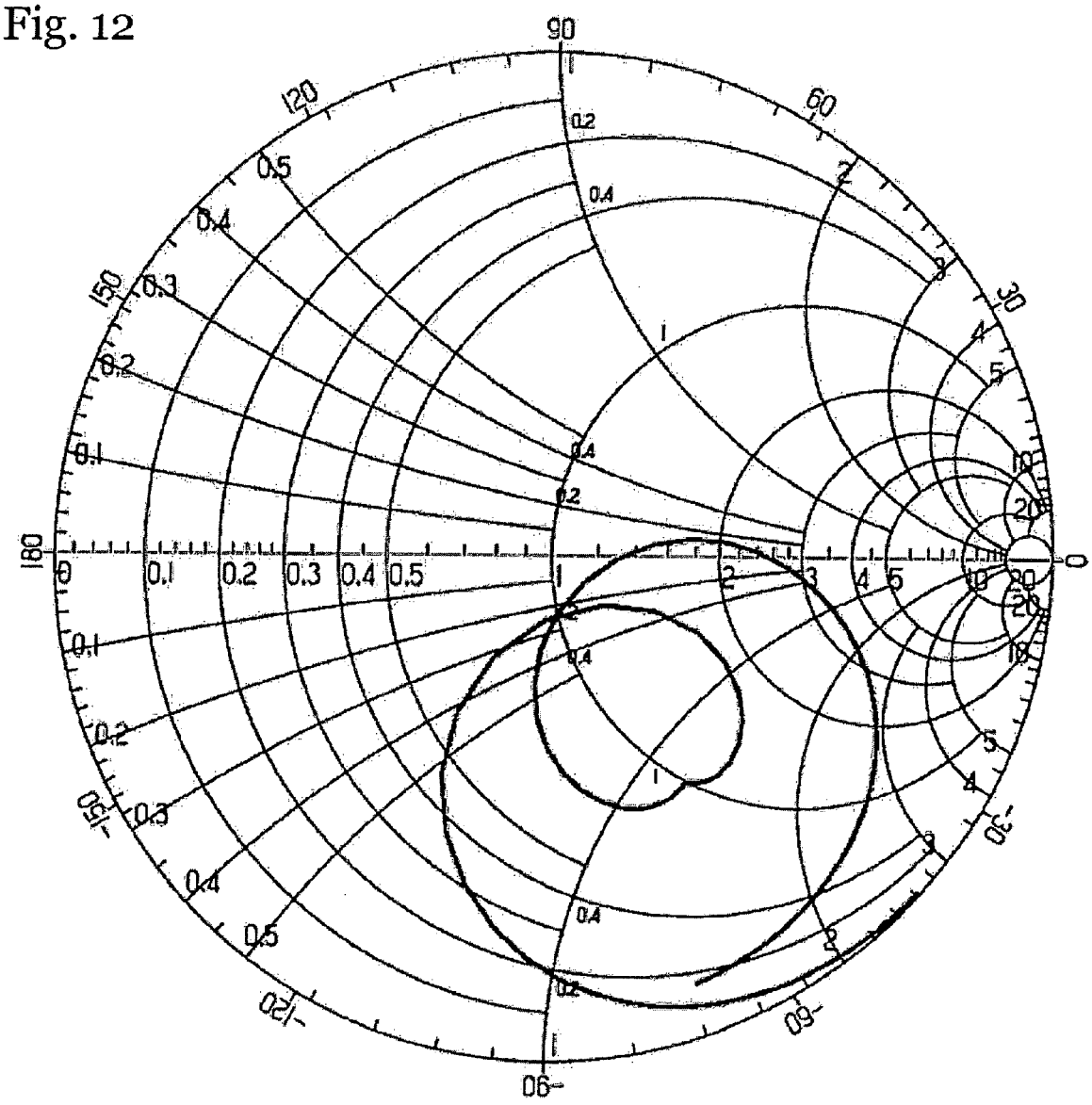
FIG. 12 is a Smith chart of the s11 characteristic of the loop antenna of the second embodiment.

The axial ratio characteristics, radiation characteristics, and a Smith chart of a 1410-MHz signal (circularly polarized waves) produced by the thus configured loop antenna are shown in FIG. 10 to FIG. 12.

FIG. 10 is a graph illustrating axial ratio characteristic simulation results for the loop antenna of the present embodiment, and FIG. 11 is a graph illustrating its radiation characteristic simulation results. In FIG. 11, "AGPRHCP" represents the radiation characteristics of the right-hand circularly polarized waves and "AGPLHCP" represents the radiation characteristics of the left-hand circularly polarized waves. It should be noted that in FIG. 10 and FIG. 11 the definition of ø and θ is the same as the definition illustrated in FIG. 4 and FIG. 5.

FIG. 12 is a Smith chart of the s11 characteristic obtained in this case.

As shown in FIG. 10 and FIG. 11, the present embodiment makes it possible to build a loop antenna possessing superior axial ratio characteristics and directivity. Additionally, as shown by the relationship between FIG. 10 and FIG. 4, as well as between FIG. 11 and FIG. 5, the present embodiment improves both the axial ratio characteristics and radiation characteristics and increases the peak gain. Specifically, while in the loop antenna shown in the first embodiment (an antenna which is substantially equivalent to a conventional curl antenna, or has somewhat better characteristics) the peak gain was about 8.7 dB, in the loop antenna shown in the present embodiment the gain is increased to a peak gain of about 9.3 dB. In this manner, the configuration of the present embodiment permits implementation of a loop antenna with better antenna characteristics (overall antenna characteristics comprising axial ratio characteristics and radiation characteristics).

It should be noted that in the present embodiment connection to external circuitry can be implemented without problems by using an impedance matching circuit such as the ones illustrated in FIG. 7 and FIG. 8 of the first embodiment.

The loop antenna of the third embodiment is explained next by referring to drawings.

Figure 13:
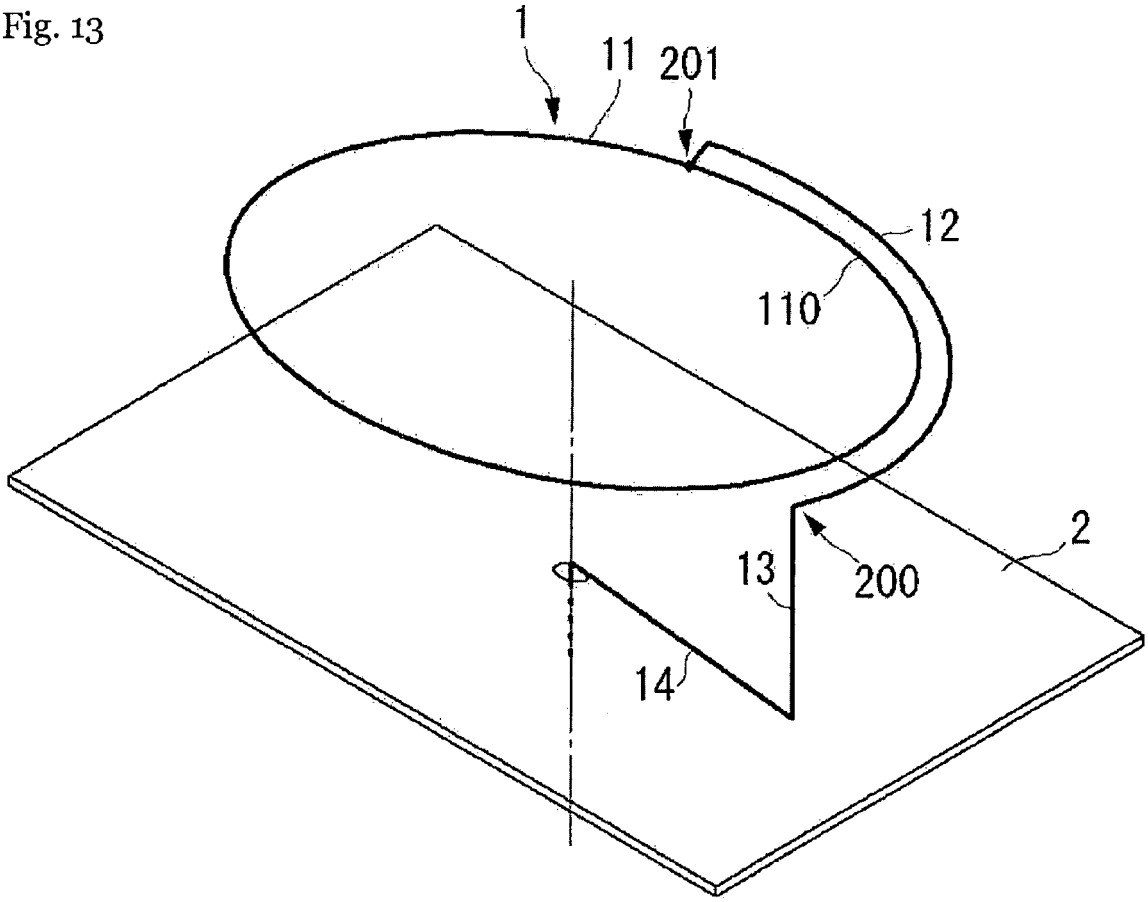
FIG. 13 is an outside perspective view showing a schematic configuration of the loop antenna of a third embodiment.

FIG. 13 is an outside perspective view illustrating a schematic configuration of the loop antenna of the present embodiment.

As shown in FIG. 13, in the loop antenna of the present embodiment, the coupling section 12 is arranged on the outside of the loop section 11, and, from the plane comprising the loop section 11, the first feed conductor 13 extends from the feed point 200 in a direction normal to the direction of the reflective plate 2, with the second feed conductor 14 formed in a shape extending in a direction parallel to the plane comprising the loop section 11 (the plane of the reflective plate 2) and the rest of the configuration being identical to the loop antenna illustrated in FIG. 1.

Figure 14:
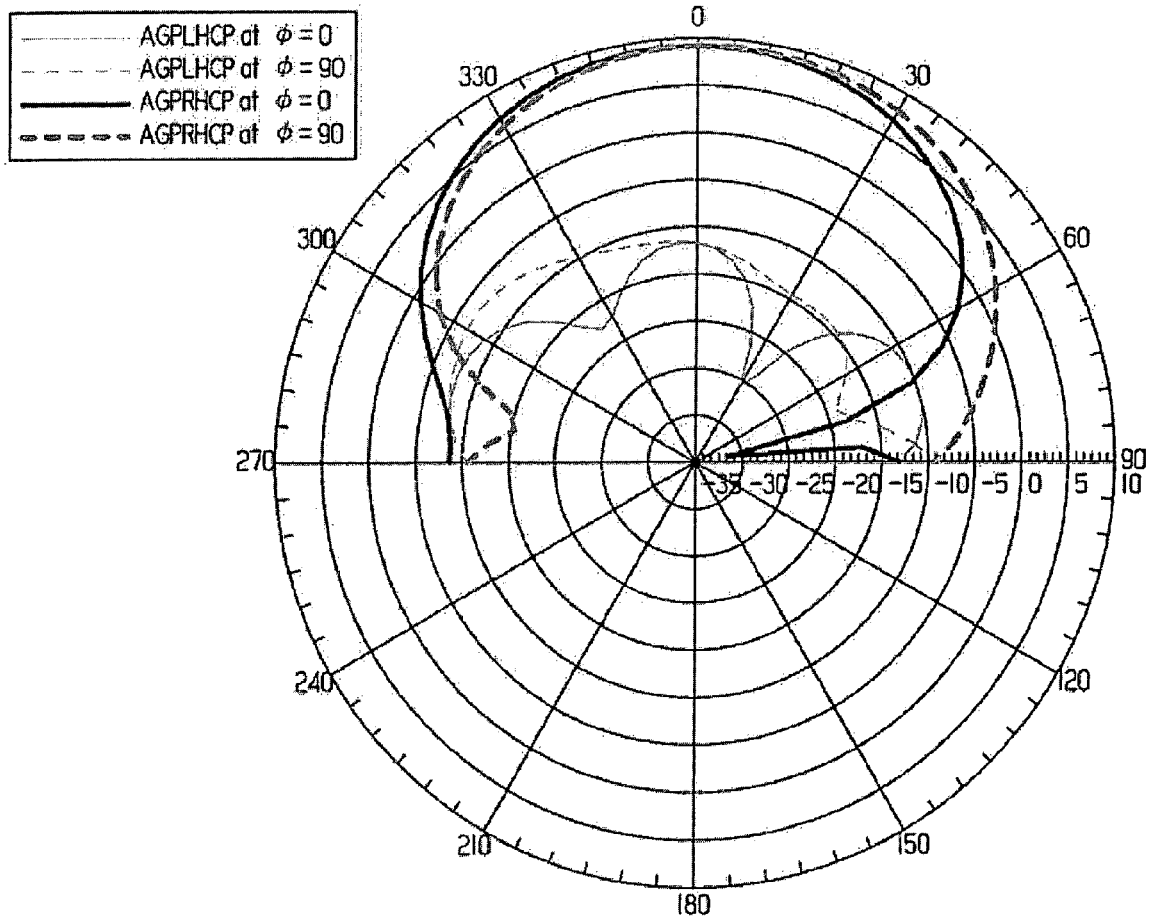
FIG. 14 is a graph illustrating radiation characteristic simulation results for the loop antenna of the third embodiment.
Figure 15:
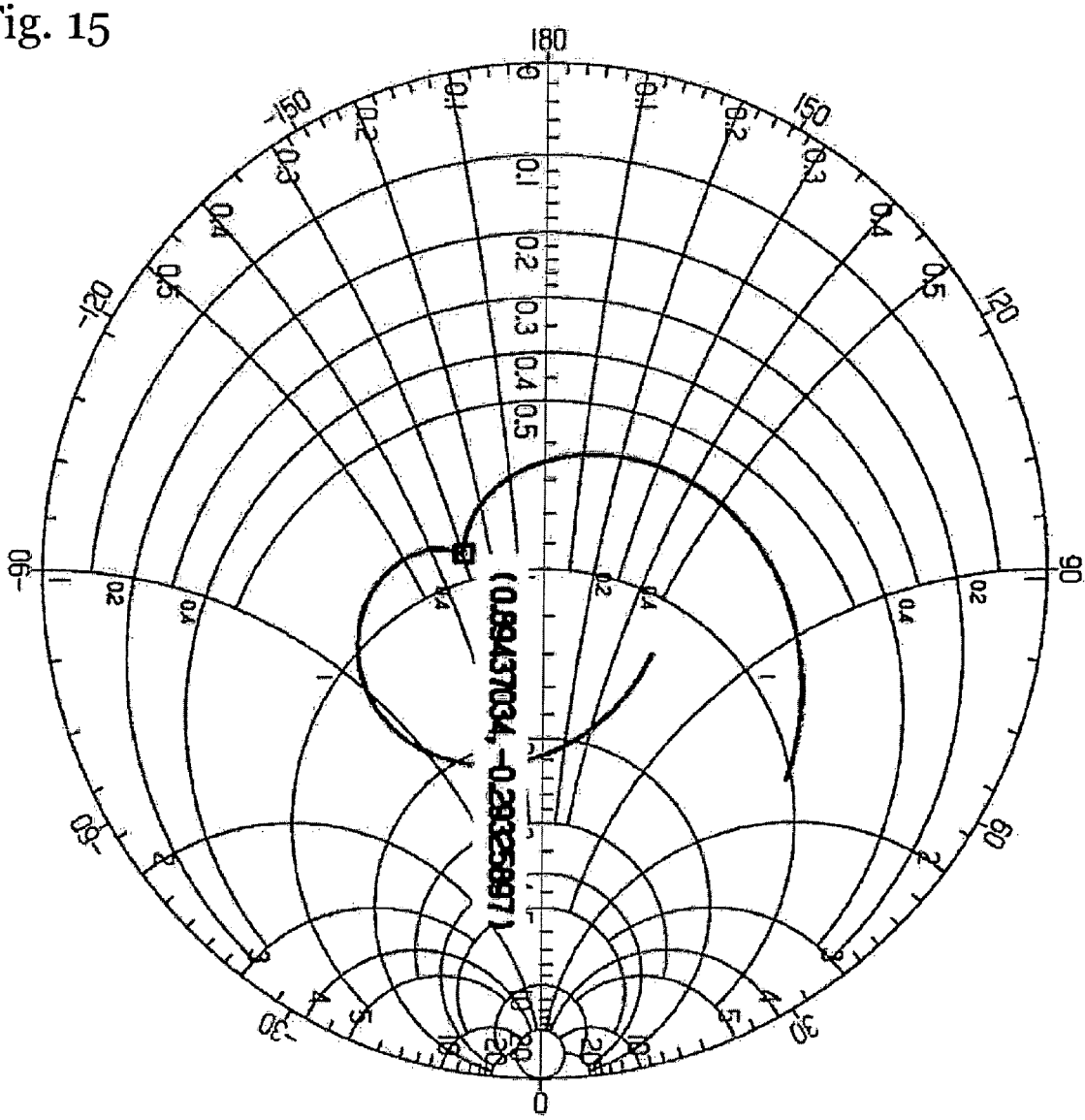
FIG. 15 is a Smith chart of the s11 characteristic of the loop antenna of the third embodiment.

The radiation characteristics and a Smith chart of a 1585.75-MHz signal (circularly polarized waves) produced by the thus configured loop antenna are shown in FIG. 14 and FIG. 15.

FIG. 14 is a graph illustrating radiation characteristic simulation results for the loop antenna of the present embodiment; in FIG. 14, "AGPRHCP" represents the radiation characteristics of right-hand circularly polarized waves and "AGPLHCP" represents the radiation characteristics of left-hand circularly polarized waves. It should be noted that in FIG. 14 the definition of ø and θ is the same as the definition illustrated in FIG. 4 and FIG. 5.

FIG. 15 is a Smith chart of the s11 characteristic obtained in this case.

As shown in FIG. 14, the configuration of the present embodiment also permits implementation of a loop antenna radiating circularly polarized waves possessing predetermined radiation characteristics. Furthermore, due to the fact that, as shown in FIG. 15, in the configuration of the present embodiment the coupling section 12 is arranged on the outer periphery of the loop section 11, the first feed conductor 13 extends normally to the direction of the reflective plate 2, and the second feed conductor 14 extends along the surface of the reflective plate 2, in this construction the impedance of the loop antenna is reduced from at least 150Ω to 50Ω and the coupling section 12, first feed conductor 13, and second feed conductor 14 are essentially provided with an impedance matching circuit. As a result, it can be connected to external circuitry operating at an impedance of 50Ω, which is often used in communication systems, without interposing an impedance matching circuit. In other words, this permits implementation of a loop antenna of a simpler construction comprising a portion connectable to external circuitry. Furthermore, the ability to directly use 50-Ω electric components and measurement devices provides for easy and inexpensive antenna assembly, tuning and inspection.

It should be noted that while in the construction illustrated in the present embodiment the first feed conductor 13 extends normally to the reflective plate 2 and the second feed conductor 14 is arranged so as to extend in parallel to the reflective plate 2, the impedance is reduced to about 50Ω simply by arranging the coupling section 12 on the outer periphery of the loop section 11. For this reason, the antenna may be constructed as shown in FIG. 16.

Figure 16:
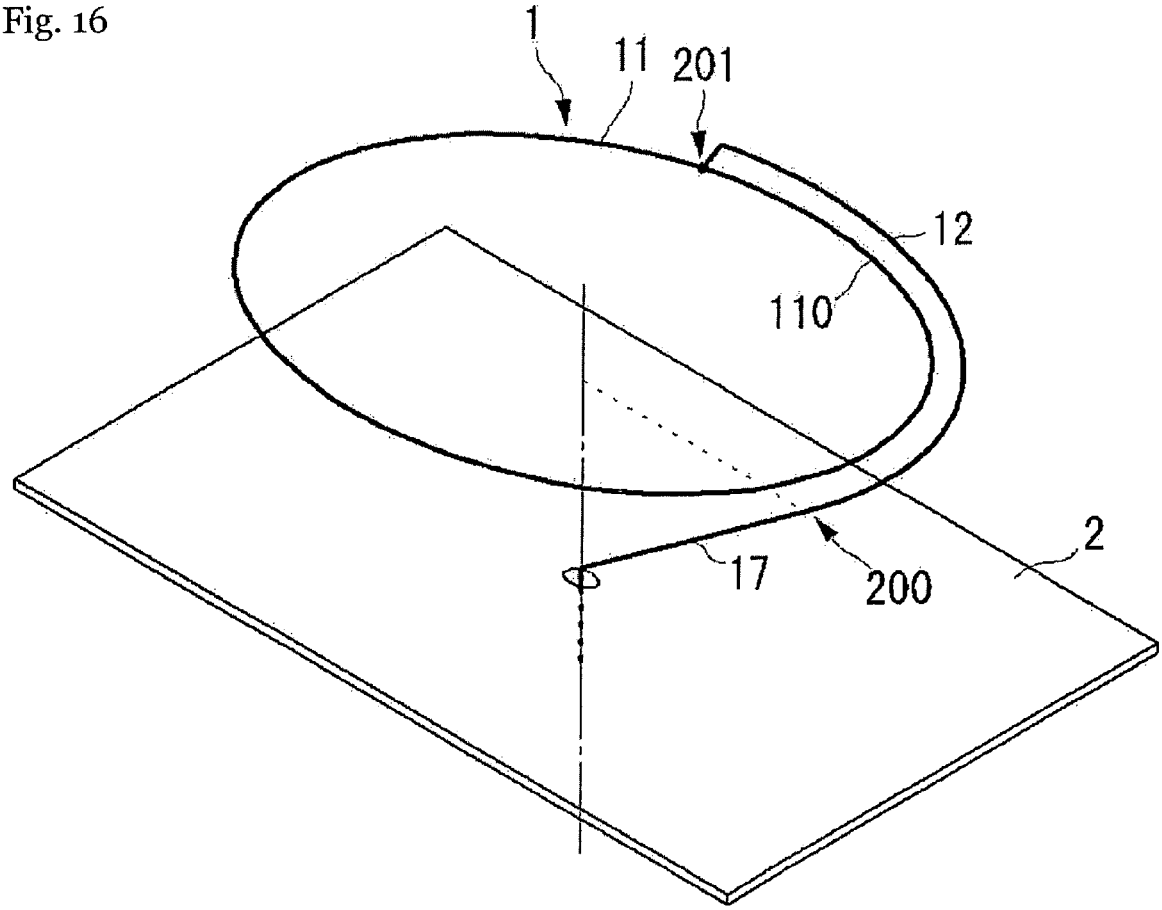
FIG. 16 is a schematic block diagram illustrating another configuration of the loop antenna of the third embodiment.
Figure 17:
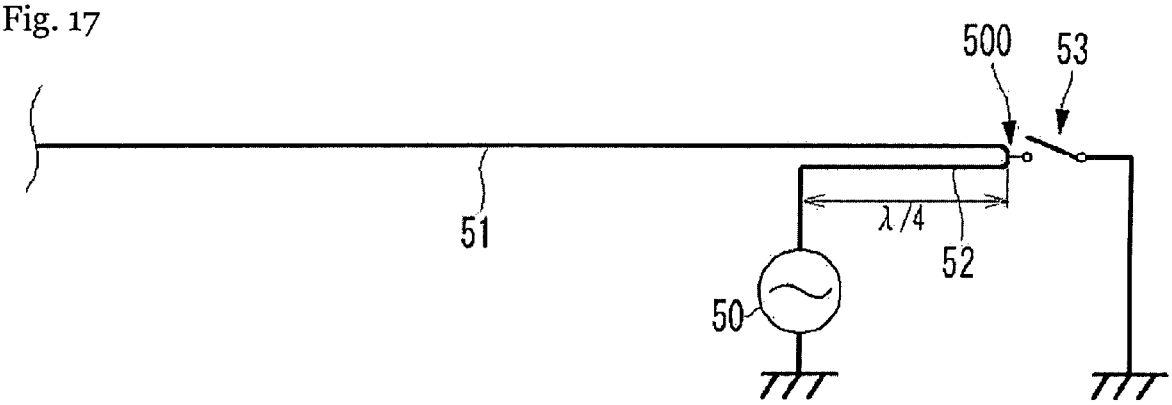
FIG. 17 is a conceptual diagram of the antenna comprising a semi-infinite line and a line used for coupling to a feed point.

FIG. 16 is a schematic block diagram illustrating another configuration of the loop antenna of the present embodiment.

The loop antenna illustrated in FIG. 16 comprises a rectilinear feed conductor 17 that runs from the feed point 200 of the coupling section 12 to the through hole in the reflective plate 2, with the rest of the configuration being identical to the loop antenna illustrated in FIG. 13. The use of this configuration further simplifies the construction of the loop antenna. It should be noted that since the construction of the feed conductor 17 is used to micro-tune the impedance of the loop antenna 1, the conductor may be of any shape, such as rectilinear, curved, etc. so long as the shape produces appropriate impedance.

Also, it should be noted that while all the embodiments described above illustrate a right-hand polarized loop antenna comprising a coupling section extending in the counterclockwise direction with respect to the feed point, a similar configuration can be applied, and the above-described effects can be obtained, in a left-hand polarized loop antenna comprising a coupling section extending in the clockwise direction with respect to the feed point.

INDUSTRIAL APPLICABILITY

This invention can be used for an antenna generating circularly polarized waves, in particular, a circularly polarized loop antenna generating circularly polarized waves from a loop conductor whose length is equal to 1 wavelength of the transmitted and received signals.

The invention claimed is:

1. A circularly polarized loop antenna comprising a loop section made up of a conductor, the length of a single turn of which is substantially equal to one wavelength of transmitted and received signals, and a single feed section performing input/output of signals to/from the loop section, wherein the single feed section comprises a coupling section comprising a first feed point connected to the loop section and a second feed point coupled to the loop section without being connected to the loop section, wherein the coupling section extends from the first feed point to the second feed point along the loop section for a length approximately equal to ¼ of the wavelength; and wherein the first and second feed points determine the circular polarization of the antenna.

2. The circularly polarized loop antenna according to claim 1, wherein the coupling section is arranged on the inner periphery of the loop section.

3. The circularly polarized loop antenna according to claim 1, wherein the coupling section is arranged on the side of the loop section facing a reflective plate.

4. The circularly polarized loop antenna according to claim 1, wherein the coupling section is arranged on the outer periphery of the loop section.

5. The circularly polarized loop antenna according to any of claims 1 through 4, wherein the feed section comprises a matching section performing impedance matching on signals supplied to the coupling section or signals outputted from the coupling section.

* * * * *